US009869962B2

(12) United States Patent
Ishida et al.

(10) Patent No.: US 9,869,962 B2
(45) Date of Patent: Jan. 16, 2018

(54) HOUSING STRUCTURE, ELECTRONIC APPARATUS, AND IMAGE FORMING APPARATUS

(71) Applicants: Masahiro Ishida, Kanagawa (JP); Naoki Matsuda, Kanagawa (JP)

(72) Inventors: Masahiro Ishida, Kanagawa (JP); Naoki Matsuda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/965,077

(22) Filed: Dec. 10, 2015

(65) Prior Publication Data

US 2016/0170368 A1 Jun. 16, 2016

(30) Foreign Application Priority Data

Dec. 12, 2014 (JP) ..... 2014-252392

(51) Int. Cl.
*G03G 15/00* (2006.01)
*G03G 21/16* (2006.01)
*G03G 21/20* (2006.01)

(52) U.S. Cl.
CPC ..... *G03G 21/1619* (2013.01); *G03G 21/206* (2013.01)

(58) Field of Classification Search
CPC ..... G03G 21/1619
See application file for complete search history.

(56) References Cited

U.S. PATENT DOCUMENTS 7,941,069 B2 * 5/2011 Idehara ..... G03G 21/1857 399/92
2002/0041362 A1 * 4/2002 Nakano ..... H04N 9/3141 353/31
2007/0059019 A1 * 3/2007 Kasama ..... G03G 15/6573 399/91
2009/0116865 A1 * 5/2009 Hanano ..... G03G 21/206 399/92
2013/0108308 A1 * 5/2013 Kondo ..... G03G 21/206 399/92
2013/0137358 A1 * 5/2013 Manahan ..... F24F 13/20 454/184
2013/0170852 A1 * 7/2013 Noguchi ..... G03G 15/2078 399/92

FOREIGN PATENT DOCUMENTS

JP 7-039097 7/1995
JP 2006-293221 10/2006
JP 2010-097036 4/2010

* cited by examiner

*Primary Examiner* — Ryan Walsh
(74) *Attorney, Agent, or Firm* — Harness, Dickey & Pierce, P.L.C.

(57) ABSTRACT

A housing structure includes a housing, a cover, and a plurality of paths of gas. The cover spatially partitions an inside and an outside of the housing. The plurality of paths of gas connect the inside and the outside of the housing and include a plurality of bypass portions. Two or more paths of gas of the plurality of paths of gas communicate with an outside of the cover via a single housing opening that communicates an inside and the outside of the cover with each other.

18 Claims, 7 Drawing Sheets

HOUSING STRUCTURE, ELECTRONIC APPARATUS, AND IMAGE FORMING APPARATUS

CROSS-REFERENCE TO RELATED APPLICATION

This patent application is based on and claims priority pursuant to 35 U.S.C. §119(a) to Japanese Patent Application No. 2014-252392, filed on Dec. 12, 2014, in the Japan Patent Office, the entire disclosure of which is hereby incorporated by reference herein.

BACKGROUND

Technical Field

Embodiments of this disclosure relate to a housing structure, an electronic apparatus, and an image forming apparatus.

Related Art

An image forming apparatus includes, for example, a cover that spatially partitions the inside and outside of a housing, and ejects the gas inside the housing heated by heat generated by various drive units when driving the apparatus to the outside of the housing has been known.

However, not only heat and but sound are generated in various driving units of the image forming apparatus at the time of driving. When providing a path of gas such as an opening that ejects the heated air inside the housing to the outside of the housing, the sound also leaks to the outside from the path of gas, and the leaking sound may become a noise. Such a situation may also occur in a housing structure including a cover member that spatially partitions the inside and outside of the housing, without being limited to the image forming apparatus.

SUMMARY

In an aspect of this disclosure, there is provided a housing structure that includes a housing, a cover, and a plurality of paths of gas. The cover spatially partitions an inside and an outside of the housing. The plurality of paths of gas connect the inside and the outside of the housing and include a plurality of bypass portions. Two or more paths of gas of the plurality of paths of gas communicate with an outside of the cover via a single housing opening that communicates an inside and the outside of the cover with each other.

In another aspect of this disclosure, there is provided an electronic apparatus that includes a sound source device to generate sound during operation, and a housing covering the sound source device and having the housing structure.

In still another aspect of this disclosure, there is provided an electrophotographic image forming apparatus comprising the electronic apparatus.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
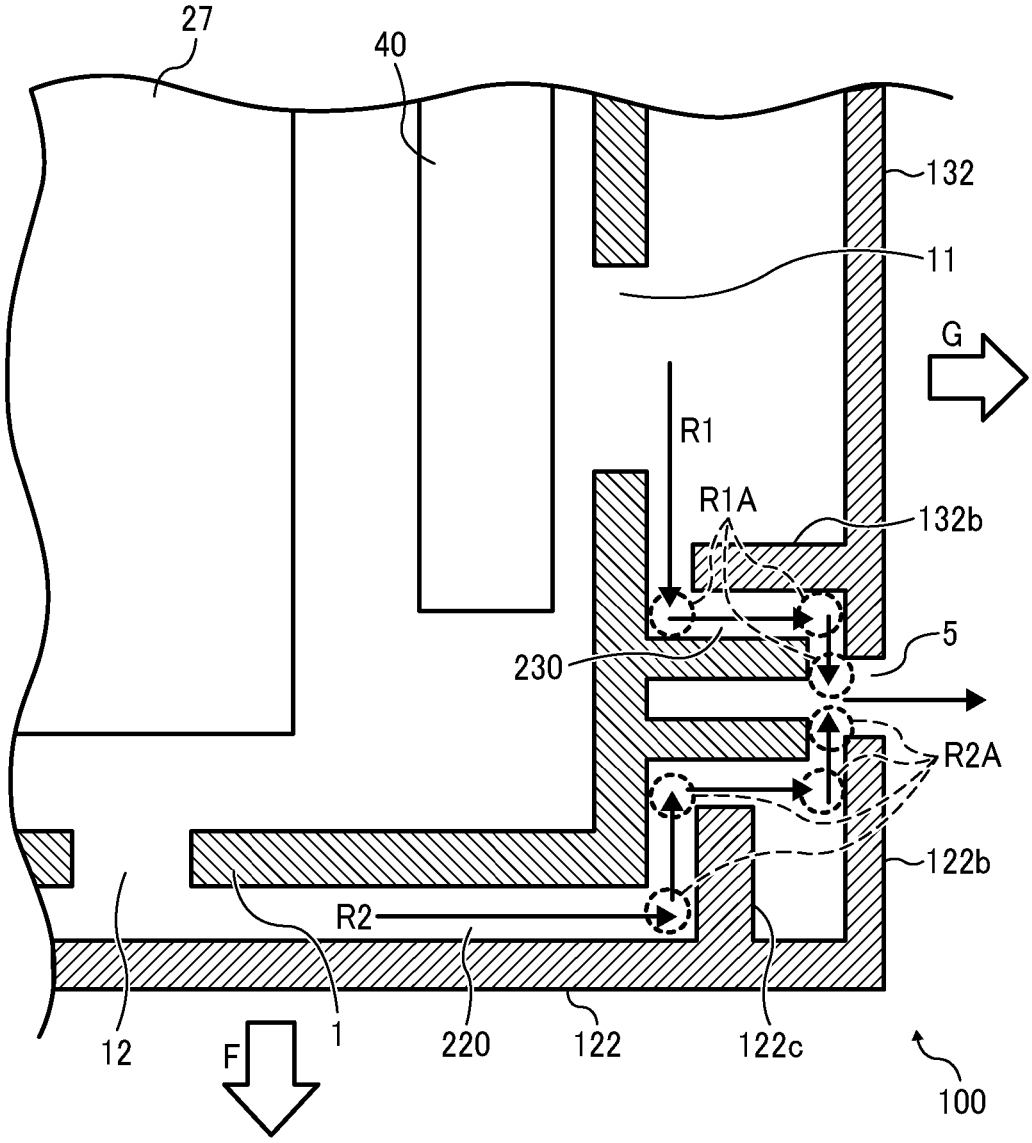
FIG. 1 is an enlarged horizontal cross-sectional view of a boundary between a front opening-and-closing cover and a right-side opening-and-closing cover of a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
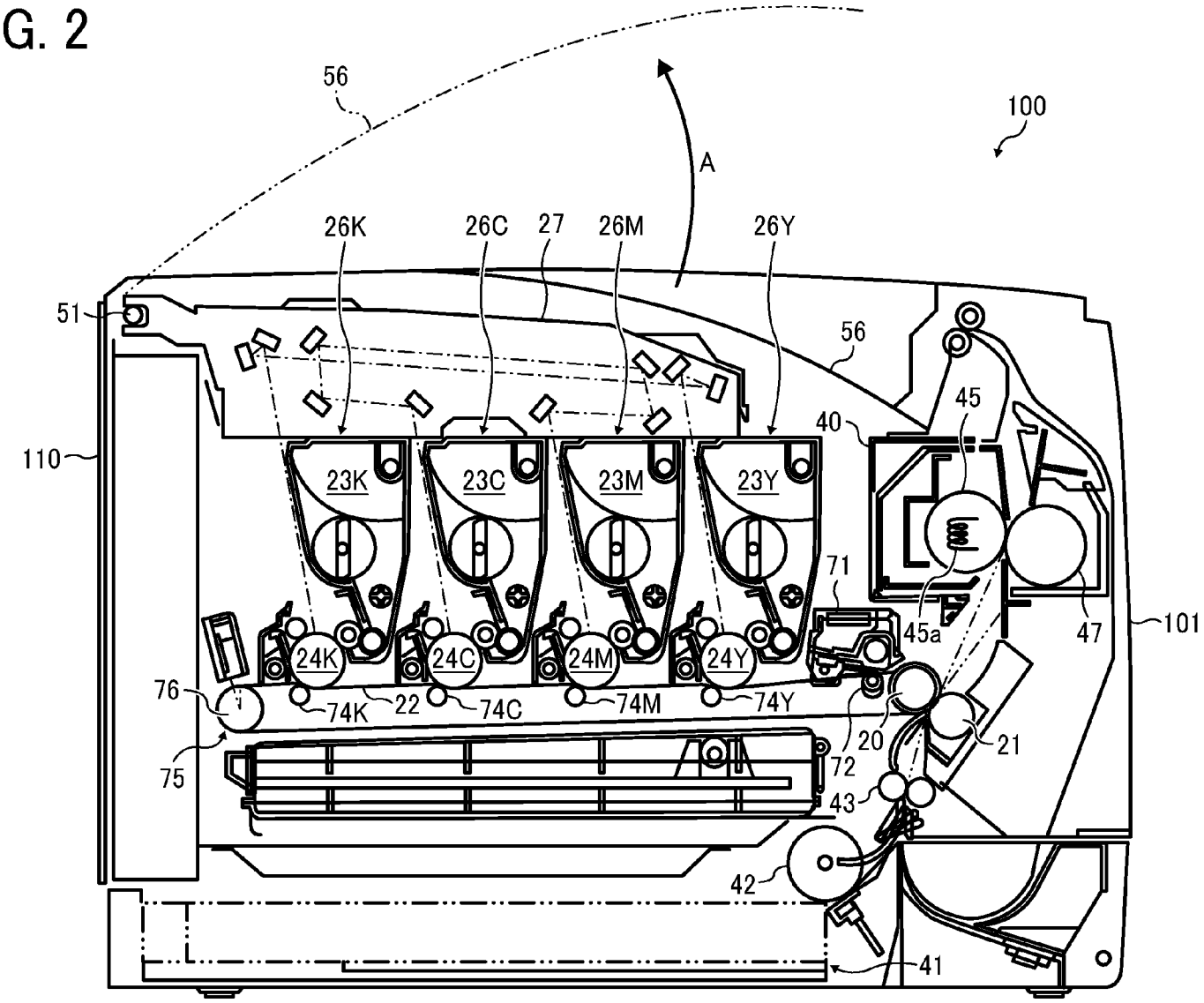
FIG. 2 is a schematic configuration diagram of a printer according to an embodiment of the present disclosure.

Hereinafter, as an image forming apparatus to which the present disclosure is applied, an embodiment of an electrophotographic printer (hereinafter, simply referred to as a "printer 100") will be described. First, a basic configuration of the printer 100 according to the present embodiment will be described. FIG. 2 is a schematic configuration diagram illustrating a printer 100. The printer 100 is equipped with four process units 26 (26K, 26C, 26M and 26Y) for forming toner images of black, cyan, magenta and yellow (hereinafter, referred to as K, C, M and Y). These use the K, C, M and Y toners of different colors from each other as image forming materials, and others the same configuration and are replaced when reaching a lifetime.

Figure 3:
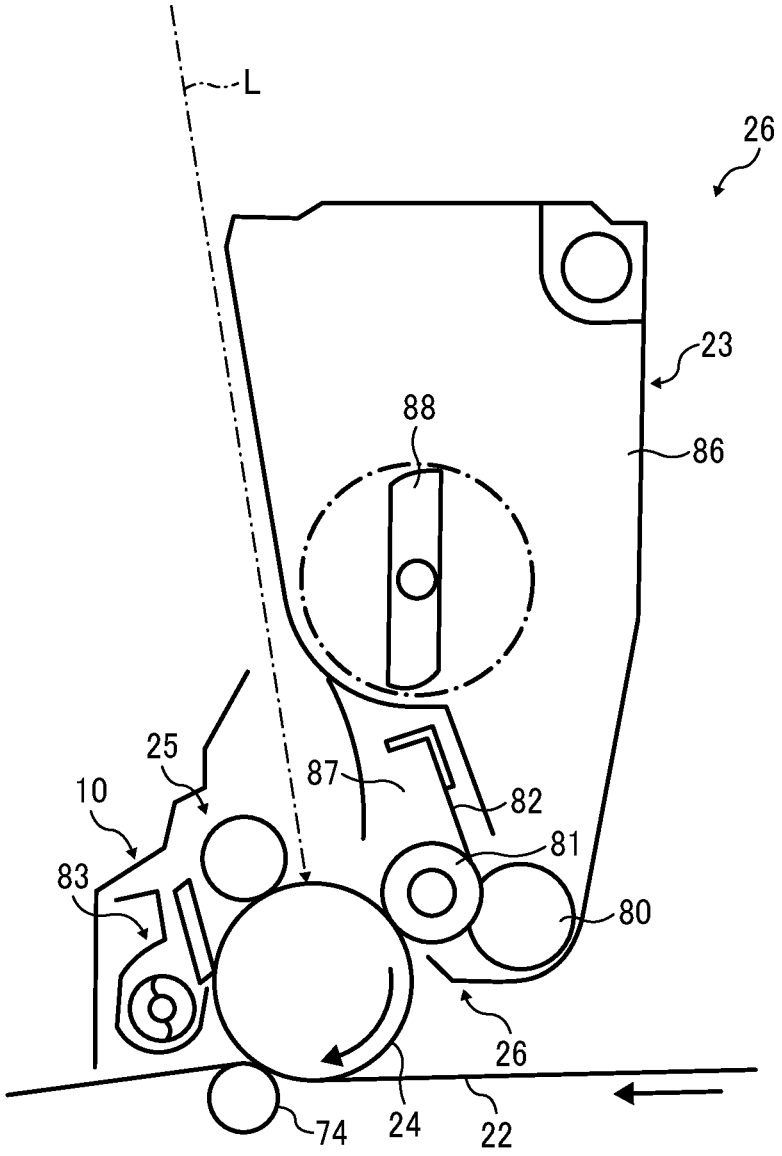
FIG. 3 is a schematic configuration diagram of a process unit in the printer.

FIG. 3 is an enlarged view of the four process units 26. Since the four process units 26 are the same except that the colors of toner used are different, the subscripts (K, C, M and Y) representing the colors of toner used in FIG. 3 are omitted. As illustrated in FIG. 3, the process unit 26 includes a photoconductor unit 10 that holds a drum-shaped photoconductor 24 as a latent image bearer, a photoconductor cleaning device 83, a neutralization device and charging device 25, and a developing unit 23 (one of developing units 23K, 23C, 23M, and 23Y illustrated in FIG. 2). The process unit 26 as an image forming unit is detachably mounted to a printer body 101 serving as a housing, and is adapted to be able to replace the consumable parts at a time.

The charging device 25 uniformly charges the surface of the photoconductor 24 which is rotationally driven in a clockwise direction in FIG. 3 by a driver. Uniformly charged surface of the photoconductor 24 is exposed and scanned by laser beam L emitted by an optical writing unit 27 to be described and carries the electrostatic latent image for each color. The electrostatic latent image is developed into a toner image by the developing unit 23 that uses toner. Further, the toner image is primarily transferred onto the intermediate transfer belt 22.

The photoconductor cleaning device 83 removes the transfer residual toner adhering to the surface of the photoconductor 24 after passing through a primary transfer process. Further, the neutralization device neutralizes the residual charge of the photoconductor 24 after cleaning. The surface of the photoconductor 24 is initialized by the neutralization and is prepared for the next image formation.

The developing unit 23 has a vertically long hopper unit 86 that houses toner as a developer, and a developing section 87. In the hopper unit 86 as a developer container, an stirrer 88 that is rotationally driven by the driver, a toner supply roller 80 as a developer supply member that is rotationally driven by the driver in the vertically lower part of the stirrer 88 and the like are disposed. The toner in the hopper unit 86 moves toward the toner supply roller 80 by its own weight, while being stirred by the rotational driving of the stirrer 88. The toner supply roller 80 has a metallic core bar and a roller unit made of foamed resin or the like coated to the surface of the core, and rotates while sticking the toner accumulated on the lower side in the hopper unit 86 to the surface of the roller unit.

A developing roller 81 that rotates, while abutting against the photoconductor 24 and the toner supply roller 80, a thinning blade 82, a tip of which is brought into contact with the surface of the toner supply roller 80 and the like are disposed in the developing section 87 of the developing unit 23. The toner adhering to the toner supply roller 80 in the hopper unit 86 is supplied to the surface of the developing roller 81 at an abutment part between the developing roller 81 and the toner supply roller 80. When the supplied toner passes through the abutment position between the developing roller 81 and the thinning blade 82 along with the rotation of the developing roller 81, the layer thickness on the surface of the developing roller 81 is restricted. Further, the toner after the layer thickness restriction adheres to the electrostatic latent image on the surface of the photoconductor 24 in the developing area that is an abutment part between the developing roller 81 and the photoconductor 24. The electrostatic latent image is developed into a toner image by the adhesion.

The formation of such a toner image is performed in each process unit 26, and the toner images of each color are formed on the respective photoconductors 24 of the respective process units 26.

As illustrated in FIG. 2, an optical writing unit 27 is disposed in the vertically upper part of the four process units 26. The optical writing unit 27 as a latent image writer optically scans the respective photoconductors 24 of the four process units 26, by the laser beam L emitted from the laser diode based on image information. The electrostatic latent images for each color are formed on the photoconductor 24 by the optical scanning. In this configuration, the optical writing unit 27 and the four process units 26 function as an imaging device that forms the K, C, M, and Y toner images as visible images of different colors of the four photoconductors 24.

The optical writing unit 27 irradiates the photoconductor 24 with the laser beam L via a plurality of optical lenses and mirrors, while polarizing the laser beam L emitted from a light source by a polygon mirror rotationally driven by the polygon motor in a main scanning direction. As the optical writing unit 27, a unit that performs the optical writing by an LED light emitted from the plurality of LEDs of the LED array may be adopted.

A transfer unit 75 as a belt device is provided in the vertically lower part of the four process units 26. The transfer unit 75 endlessly moves an endless-shaped intermediate transfer belt 22 in a counterclockwise direction in FIG. 2, while stretching the belt 22. The transfer unit 75 is equipped with a drive roller 76, a tension roller 20, four primary transfer rollers 74 (74K, 74C, 74M and 74Y), a secondary transfer roller 21, a belt cleaning device 71, a cleaning backup roller 72 and the like, in addition to the intermediate transfer belt 22.

The intermediate transfer belt 22 serving as a belt member and a transfer belt is stretched by the drive roller 76, the tension roller 20, the cleaning backup roller 72 and the four primary transfer rollers 74 (74K, 74C, 74M and 74Y) that are disposed inside the loop. Moreover, the belt 22 is endlessly moved in the same direction by the rotational force of the drive roller 76 that is rotationally driven in the counterclockwise direction in FIG. 2 by a driver.

The four primary transfer rollers 74 (74K, 74C, 74M and 74Y) interposes the intermediate transfer belt 22 that is endlessly moved in this way between the rollers 74 and the photoconductors 24 (24K, 24C, 24M and 24Y). Primary transfer nips of the four positions of K, C, M and Y are formed by the interposition, and the front of the intermediate transfer belt 22 and the photoconductors 24 (24K, 24C, 24M and 24Y) abut against each other at the primary transfer nips.

A primary transfer bias is applied to each of the primary transfer rollers 74 (74K, 74C, 74M and 74Y) by a transfer bias supply, and thus, a transfer electric field is formed between the electrostatic latent images of the photoconductors 24 (24K, 24C, 24M and 24Y) and the primary transfer rollers 74 (74K, 74C, 74M and 74Y). A transfer charger or a transfer brush may be adopted in place of the primary transfer roller 74.

A Y toner formed on a surface of a yellow photoconductor 24Y of a yellow process unit 26Y enters the Y primary transfer nip along with the rotation of the yellow photoconductor 24Y. In the Y primary transfer nip, the Y toner is primarily transferred onto the intermediate transfer belt 22 from the yellow photoconductor 24Y by the action of the transfer electric field and the nip pressure. In this way, when the intermediate transfer belt 22 onto which the Y toner image is primarily transferred passages through the M, C and K primary transfer nips along with its endless movement, the M, C and K toner images on the photoconductors 24 (24M, 24C and 24K) are sequentially superimposed on the Y toner image and are primarily transferred onto the Y toner image. By the primary transfer of the superposition, four-color toner images are formed on the intermediate transfer belt 22.

The secondary transfer roller 21 of the transfer unit 75 is disposed outside the loop of the intermediate transfer belt 22, and interposes the intermediate transfer belt 22 between the roller 21 and the tension roller 20 inside the loop. A secondary transfer nip is formed by the interposition, and the front surface of the intermediate transfer belt 22 abuts against the secondary transfer roller 21 at the secondary transfer nip. A secondary transfer bias is applied to the secondary transfer roller 21 by the transfer bias supply. By the application, a second transfer electric field is formed between the secondary transfer roller 21 and the ground-connected tension roller 20.

In the vertically lower part of the transfer unit 75, a sheet feed tray 41 that houses recording sheets in a state of a sheet bundle with multiple superimposed sheets is disposed in a slide-removably mountable manner with respect to the housing of the printer 100. The sheet feed tray 41 causes the sheet feed roller 42 to abut against the uppermost recording sheet of the sheet bundle, and by rotating the roller 42 in the counterclockwise direction in FIG. 2 at a predetermined timing, the sheet feed tray 41 sends the recording sheet toward the sheet feed path.

A registration roller pair 43 made up of two registration rollers is disposed near the terminal end of the sheet feed path. The registration roller pair 43 stops the rotation of both rollers, as soon as the recording sheet as a recording material sent from the sheet feed tray 41 is interposed between the rollers. Further, the rotational driving is resumed at a timing capable of synchronizing the interposed recording sheet with the four-color toner images on the intermediate transfer belt 22 in the secondary transfer nip, and the recording sheet is sent toward the second transfer nip.

The four-color toner images on the intermediate transfer belt 22 which is in close contact with the recording sheet at the secondary transfer nip are collectively and secondarily transferred onto the recording sheet under the influence of the secondary transfer electric field and the nip pressure, and become full-color toner images in combination with white of the recording sheet. In this way, when the recording sheet with the full-color toner images formed on the surface passes through the secondary transfer nip, the curvature is separated from the secondary transfer roller 21 and the intermediate transfer belt 22. Further, the recording sheet is fed into the fixing device 40 as a fixing unit via a post-transfer conveyance path.

The post-transfer residual toner that is not transferred onto the recording sheet adheres to the intermediate transfer belt 22 after passing through the secondary transfer nip. The post-transfer residual toner is cleaned from the belt surface by the belt cleaning device 71 that is in contact with the front surface of the intermediate transfer belt 22. A cleaning backup roller 72 disposed inside the loop of the intermediate transfer belt 22 backs up the cleaning of the belt using the belt cleaning device 71 from the inside of the loop.

The fixing device 40 is provided with a fixing roller 45 that encloses a heat generator 45*a* such as a halogen lamp, and a pressure roller 47 that rotates while abutting against the fixing roller 45 at a predetermined pressure, and a fixing nip is formed by the fixing roller 45 and the pressure roller 47. The recording sheet sent into the fixing device 40 is interposed at the fixing nip so that an unfixed toner-image bearing surface is brought into close contact with to the fixing roller 45. The toner in the toner image is softened by the influence of heat and pressure, and a full-color image is fixed.

When a single-side print mode is set, the recording sheet emitted from the fixing device 40 within is directly emitted to the outside. Further, the recording sheet is stacked on a stack portion formed on the upper surface of the upper cover 56 of the housing.

As indicated by an arrow A in FIG. 2, the upper cover 56 of the housing of the printer 100 is rotatably supported around the upper cover shaft 51, and rotates in the counterclockwise direction in FIG. 2 to enter a state that is open to the housing of the printer 100. Further, the upper opening of the housing of the printer 100 is greatly exposed. Also, the optical writing unit 27 is also rotatably supported around the upper cover shaft 51, and by rotating the optical writing unit 27 in the counterclockwise direction in FIG. 2, the upper surfaces of four process units 26 (26K, 26C, 26M and 26Y) can be exposed.

The process units 26 (26K, 26C, 26M and 26Y) are attached and detached by opening the upper cover 56 and the optical writing unit 27. Specifically, after exposing the upper surface of the process units 26 (26K, 26C, 26M and 26Y) by opening the upper cover 56 and the optical writing units 27, by pulling the process units 26 (26K, 26C, 26M and 26Y) in a vertically upward direction, the process units are removed from the printer body 101.

By opening the upper cover 56 and the optical writing unit 27 to perform attachment and detachment of the process unit 26 with high detachment frequency, it is possible to check the attachment and detachment operations, while looking the interior of the housing from the upside, without taking unnatural attitudes such as crouching, bending the waist or bending the printer body 101. Therefore, it is possible to reduce the workload or to suppress an occurrence of operation error.

Further, in the present embodiment, although the process unit 26 equipped with the photoconductor unit 10 and the developing unit 23 is removably mountable from the printer body 101, each of the developing unit 23 and the photoconductor unit 10 may be removably mountable from the printer body 101.

Figure 4:
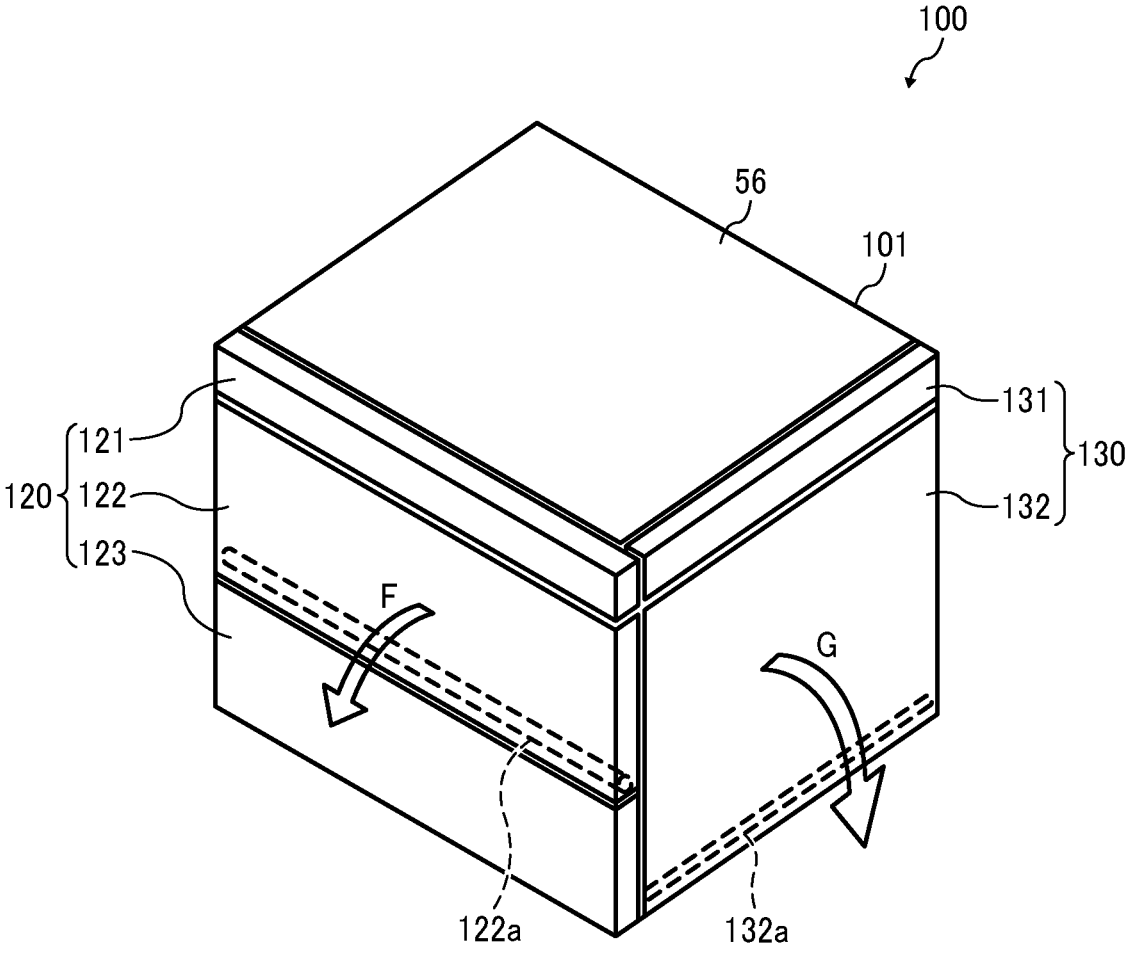
FIG. 4 is an explanatory perspective view of a printer schematically illustrating an example of a configuration in which each of a front cover and a right side cover has an opening-and-closing cover.

FIG. 4 is an explanatory perspective view of the printer 100 schematically illustrating an embodiment of a configuration in which each of a front cover 120 that covers the front side in FIG. 2 of the printer 100 and a right side cover 130 that covers the right-side has an opening-and-closing cover. Also, the printer 100 is equipped with a body frame that supports the respective devices used for image formation and constitutes a framework of the device, and in order to perform maintenance, component replacement or the like, a plurality of outer covers is fixed to the main frame by being fastened with screws in a removable state. Although a frame made of a metal such as iron or aluminum can be adopted as the body frame, it is not limited to metal, and a frame made of a material that maintains the rigidity for supporting the respective devices may be adopted.

The front cover 120 is equipped with a front upper cover 121 and a front lower cover 123 as stationary cover members fixed to the body frame, and a front opening-and-closing cover 122 as an opening-and-closing cover that is rotatable around a front-cover rotary shaft 122*a*. The right side cover 130 is equipped with a right-side upper cover 131 as a stationary cover member fixed to the body frame, and a right-side opening-and-closing cover 132 as an opening-and-closing cover that is rotatable around the right-side cover rotary shaft 132*a*. The front opening-and-closing cover 122 can be opened by rotating in a direction indicated by arrow F in FIG. 4 around the front-cover rotary shaft 122*a*, and the right-side opening-and-closing cover 132 can be opened by rotating in a direction indicated by arrow G in FIG. 4 around the right-side cover rotary shaft 132*a*.

[First Embodiment]

Next, a first embodiment (hereinafter, referred to as a "first embodiment") of the housing structure to which the present disclosure is applied will be described. FIG. 1 is an enlarged horizontal cross-sectional view of a boundary between the front opening-and-closing cover 122 and the right-side opening-and-closing cover 132 of the printer 100 of the first embodiment. Arrows F and G in FIG. 1 illustrate a rotation direction at the time of opening the front opening-and-closing cover 122 and the right-side opening-and-closing cover 132 described with reference to FIG. 4.

The right-side opening-and-closing cover 132 is equipped with a right-side-cover projection 132*b* protruding toward the inside of the apparatus, at a position that is slightly away from the front opening-and-closing cover 122 further than the end portion of the front opening-and-closing cover 122 side. Meanwhile, the front opening-and-closing cover 122 has a first front-cover projection 122*b* and a second front-cover projection 122*c* that sequentially protrude toward the inside of the apparatus from the end portion of the right-side opening-and-closing cover 132 side.

As illustrated in FIG. 1, the front opening-and-closing cover 122 and the right-side opening-and-closing cover 132 are opened and closed in directions different from each other to form an outer cover opening 5 that serves as an exit of flow the sound and the air from the interior of the apparatus at a boundary between the front opening-and-closing cover 122 and the right-side opening-and-closing cover 132. Also, the printer 100 is equipped with an interior cover 1 fixed to the body frame on the inside of the two outer covers (the front opening-and-closing cover 122 and the right-side opening-and-closing cover 132). The respective apparatuses used for image formation, such as the fixing device 40 and the optical writing unit 27 are disposed inside the interior cover 1, and the respective devices are not exposed only by opening the outer cover.

There is a gap 230 between the interior cover 1 and the right-side opening-and-closing cover 132, and a first path R1 through which the internal heat and sound of the device are directed to the outer cover opening 5 is formed by the gap 230. Further, there is also a gap 220 between the interior cover 1 and the front opening-and-closing cover 122, and a second path R2 through which the internal heat and sound of the device are directed to the outer cover opening 5 is formed by the gap 220. The first path R1 and the second path R2 connect the interior of the interior cover 1 and the exterior of the outer cover, and have three or more bent portions R1A and R2A in which the path of gas through which sound and heat are transmitted changes at a right angle. Thus, it is possible to diffract sound that tries to leak to the outside as compared to the two bent portions R1A and R2A, and it is possible to enhance the effects of sound leakage prevention. In the printer 100, a first interior opening 11 is provided on a surface of the interior cover 1 facing the right-side opening-and-closing cover 132, and a second interior opening 12 is formed on the surface facing the front opening-and-closing cover 122.

The fixing device 40 is a heat source having a heat generator 45*a*, a plurality of rollers is disposed inside and around the fixing device 40, and the rollers become the sound source at the time of driving. Heat and sound generated from the fixing device 40 and the periphery thereof are transmitted to the gap 230 between the interior cover 1 and the right-side opening-and-closing cover 132 from the inside of the interior cover 1 through the first interior opening 11, and is emitted to the outside the apparatus from the outer cover opening 5 through the first path R1 formed by the gap 230. When the optical writing unit 27 rotates a polygon mirror at a high speed by a polygon motor, the heat and sound are generated. The heat and sound generated from the optical writing unit 27 are transmitted to the gap 220 between the interior cover 1 and the front opening-and-closing cover 122 from the inside of the interior cover 1 through the second interior opening 12, and is emitted to the outside the apparatus from the outer cover opening 5 through the second path R2 formed by the gap 220.

As in the first interior opening 11 and the second interior opening 12, a plurality of inner cover openings through which the inside and the outside of the interior cover 1 communicate with each other is provided. Furthermore, the respective inner cover openings are in communication with the outer cover opening 5 via different paths of gas such as the first path R1 and the second path R2, respectively. Thus, it is possible to emit heat from the inner cover opening close to the heat source in the interior cover 1 to the outside of the interior cover 1, and it is possible to further emit the heat from the outer cover opening 5 to the outside the apparatus through the path of gas that communicates with the inner cover opening. This prevents the heat from being confined inside the interior cover 1, and it is possible to suppress the temperature rise inside the interior cover 1.

In the printer 100, various sounds such as the driving noise of the drive motor that transmits the rotational driving to the various rollers, the moving sound of the moving member such as various rollers and a rotation sound of the polygon mirror of the optical writing unit 27 are generated. Such sounds may be transmitted to the outside of the printer 100, and there is a risk of a noise that imparts uncomfortable feeling to surround people. The outer cover (the front opening-and-closing cover 122 and the right-side opening-and-closing cover 132) that spatially partitions the outside and inside of the printer 100 can suppress the sound generated inside from being transmitted to the outside, and can suppress an occurrence of noise.

As illustrated in FIG. 1, there is a gap 220 between the front opening-and-closing cover 122, the right-side opening-and-closing cover 132 and the interior cover 1, and the first path R1 and the second path R2 are formed. Since air can pass through the first path R1 and the second path R2, heat generated inside the printer 100 can be emitted to the outside through the first path R1 and the second path R2, and it is possible to suppress the temperature rise inside the printer 100. Further, the first path R1 and the second path R2 has a labyrinth shape having the bent portions R1A and R2A of the plurality of positions. Therefore, the sound generated inside the printer 100 and directed to the outside through the first path R1 or the second path R2 cannot exit to the outside of the printer 100 if the sound is not diffracted for a plurality of times. Since the sound is attenuated each time it is diffracted, the sound leakage can be suppressed by diffracting the sound directed toward the outside from the inside for a plurality of times.

Further, in the complicated labyrinth shape having the bent portions R1A and R2A of the plurality of positions, the airflow is hard to pass and the flow rate decreases. In contrast, in the printer 100, by having a plurality of paths of gas between the first path R1 and the second path R2, it is possible to ensure an airflow directed from the inside to the outside of the apparatus. Thus, even in a configuration in which a labyrinth shape is provided in the path of gas, the exhaust heat efficiency can be maintained. Further, by providing a single outer cover opening 5 through which the first path R1 and the second path R2 communicate with the outside the apparatus, it is possible to reduce the housing opening through which the sound generated inside the apparatus leaks to the outside. This enables suppression of the sound leakage compared to a configuration in which each of the plurality of paths of gas communicates with the outside via the individual housing openings. Thus, in the printer 100 of the first embodiment, it is possible to suppress the sound leakage, while preventing the temperature rise inside the device, by ensuring the airflow directed from the inside to the outside of the apparatus.

In the image forming apparatus such as a printer 100, it is necessary to provide an opening-and-closing cover, such as a front opening-and-closing cover 122 and a right-side opening-and-closing cover 132 that are opened and closed at the time of a paper-jam processing and an addition of sheet. When sound generated inside the apparatus from the gap between the opening-and-closing cover and the other outer cover leaks to the outside, the sound becomes a cause of noise. When providing a configuration in which the opening-and-closing cover and the other outer cover are superimposed with each other to come into contact with each other and there is no gap, there is a risk of galling or abutment between the outer covers due to slight precision error of the components.

Therefore, it is difficult to provide a configuration in which the opening-and-closing cover and the other outer cover are superimposed with each other to come into contact with each other and there is no gap, and in order to prevent a gap from being generated, it is necessary to provide an elastic member such as a sponge in a portion of a boundary between the opening-and-closing cover and the other outer cover. Addition of the elastic member in the outer cover leads to an increase in the number of components, and there is a risk of an increase in the manufacturing cost. Moreover, since there is no gap, it is not possible to release the internal heat of the apparatus to the outside from the boundary between the opening-and-closing cover and the other outer cover.

In contrast, in the printer 100, the boundary between opening-and-closing cover and the other outer cover is the outer cover opening 5, and the first path R1 and the second path R2 that transmit the sound from the interior of the apparatus to the outer cover opening 5 has a labyrinth shape. With such a configuration, by releasing the heat inside the printer 100 from the outer cover opening 5 through the first path R1 or the second path R2, while suppressing the sound inside the apparatus from leaking to the outside, the temperature rise can be suppressed. Furthermore, since it is not necessary to dispose the elastic member at a portion of a boundary between the outer covers, it is possible to suppress an increase in the manufacturing cost.

Further, by forming the first path R1 and the second path R2 in the gaps 220 and 230 between the front opening-and-closing cover 122, the right-side opening-and-closing cover 132 and the interior cover 1, there is no need to provide a new member for forming the paths of gas. Thus, it is possible to suppress the cost of providing a path of gas having a labyrinth shape. Also, the opening-and-closing cover such as the front opening-and-closing cover 122 and the right-side opening-and-closing cover 132 needs form a gap between the opening-and-closing cover and the inner member such as the interior cover 1 exposed by being opened. By forming the first path R1 and the second path R2 in the gaps 220 and 230, there is no need to provide a new member for forming the path of gas, and it is possible to suppress the cost of providing the path of gas having a labyrinth shape.

Also, like the front opening-and-closing cover 122 and the right-side opening-and-closing cover 132, when both the outer covers forming a gap serving as the path of gas are the opening-and-closing cover, unless both covers are openable and closable from either side, the usability is adversely affected. Further, in the portion in which the opening-and-closing covers are adjacent to each other, since the gap increases in consideration of the movable range as compared to a portion in which the other outer covers are adjacent to each other, sound leakage tends to increase. Even in such a case, by setting the boundary between the opening-and-closing covers as the outer cover opening 5, and by setting the path of gas leading to the outer cover opening 5 as the first path R1 and the second path R2 having a labyrinth shape, it is possible to diffract the sound for a plurality of times and to reduce the sound leakage.

The widths of the first path R1 and the second path R2 in which the opening-and-closing cover and the interior cover 1 do not come into contact with each other when closing the opening-and-closing cover is set as follows. That is, in a state in which the closing of the front opening-and-closing cover 122 is completed, the front opening-and-closing cover 122 is at a position illustrated in FIG. 1. When large force more than necessary acts on the front opening-and-closing cover 122 to close it, the front opening-and-closing cover 122 abutting against the stopper such as a main frame is further elastically deformed, and moves up to the position closer to the interior cover 1 side than the state illustrated in FIG. 1. At this time, the width of the second path R2 in the state illustrated in FIG. 1 is set to be larger than an amount of movement when the front opening-and-closing cover 122 moves to the position closer to the interior cover 1 side than the state illustrated in FIG. 1.

As the amount of movement when the front opening-and-closing cover 122 moves to the position closer to the interior cover 1 than the state illustrated in FIG. 1, it is desirable to set an amount of movement when a deformation amount is maximum in a range in which the front opening-and-closing cover 122 can be elastically deformed. When the front opening-and-closing cover 122 is deformed beyond the range in which the deformation amount is maximum in the range that can be elastically deformed, the front opening-and-closing cover 122 is elastically deformed and is in a broken state, and since this is a state that cannot be continuously used, it is not necessary to consider this case. In contrast, if it is in the range that can be elastically deformed, the front opening-and-closing cover 122 is in the state that can be continuously used, rather than the broken state. Thus, the amount of movement when the deformation amount is maximum in the range in which the front opening-and-closing cover 122 can be elastically deformed is set as an amount of movement when the front opening-and-closing cover 122 moves to a position closer to the interior cover 1 side than the state illustrated in FIG. 1. This makes it possible to prevent a portion for forming the second path R2 from coming into contact with the interior cover 1, even if the front opening-and-closing cover 122 is deformed in a continuously usable range. Further, the relation between the right-side opening-and-closing cover 132 and the first path R1 is also the same.

In the printer 100 of the first embodiment, a gap that forms the first path R1 and the second path R2 is set to a size that allows variations in component tolerances of the right-side opening-and-closing cover 132, the front opening-and-closing cover 122 and the interior cover 1, and in clearance of the movable part. That is, even under the condition in which the component tolerance and the clearance of the movable part narrow the gap to the highest degree, the gap is set to a value in which the gap is not closed by the right-side opening-and-closing cover 132 or the front opening-and-closing cover 122 and the interior cover 1. Thus, it is possible to release the heat from the first path R1 and the second path R2 formed by the gap, and it is possible to suppress the temperature rise inside the printer 100.

By providing the interior cover 1 like the printer 100, even when opening the right-side opening-and-closing cover 132 and the front opening-and-closing cover 122, it is possible to achieve a configuration in which each apparatus used for the image formation is not exposed. As illustrated in FIG. 1, the labyrinth shapes of the first path R1 and the second path R2 are provided near the outer cover opening 5. Thus, the labyrinth shape in which heat is likely to stagnate is provided near the housing opening, and thus, it is possible to suppress temperature rise inside the housing in the first path R1 and the second path R2.

As the configuration in which the labyrinth shape is provided in the path that connects the inside and the outside, a configuration in which the labyrinth shape is formed in the gap as the boundary between the adjacent outer covers is considered. However, when providing the labyrinth shape in the gap between the outer covers, as the labyrinth is formed, the thickness of the outer cover increases, which may lead to an increase in size of the entire image forming apparatus.

Also, as in the first embodiment, when the adjacent outer covers are both the opening-and-closing covers, the following problems may occur. That is, although the opening-and-closing cover needs rattling to some extent in order to move, the gap providing the labyrinth shape is affected by two rattling of the opening-and-closing cover. When the variation of rattling is large, as a labyrinth shape is not attained, the gap becomes wider, the opening-and-closing covers come into contact with each other, and a gap may not be formed. Further, in order to accurately ensure a gap, when making an attempt to reduce the variation of rattling, it is necessary to increase the component accuracy. In contrast, by forming the gap providing the labyrinth shape by a single opening-and-closing cover and a single fixing member (such as the interior cover 1), it is possible to suppress rattling that affects the gap to one rattling of the opening-and-closing cover.

[Second Embodiment]

Figure 5:
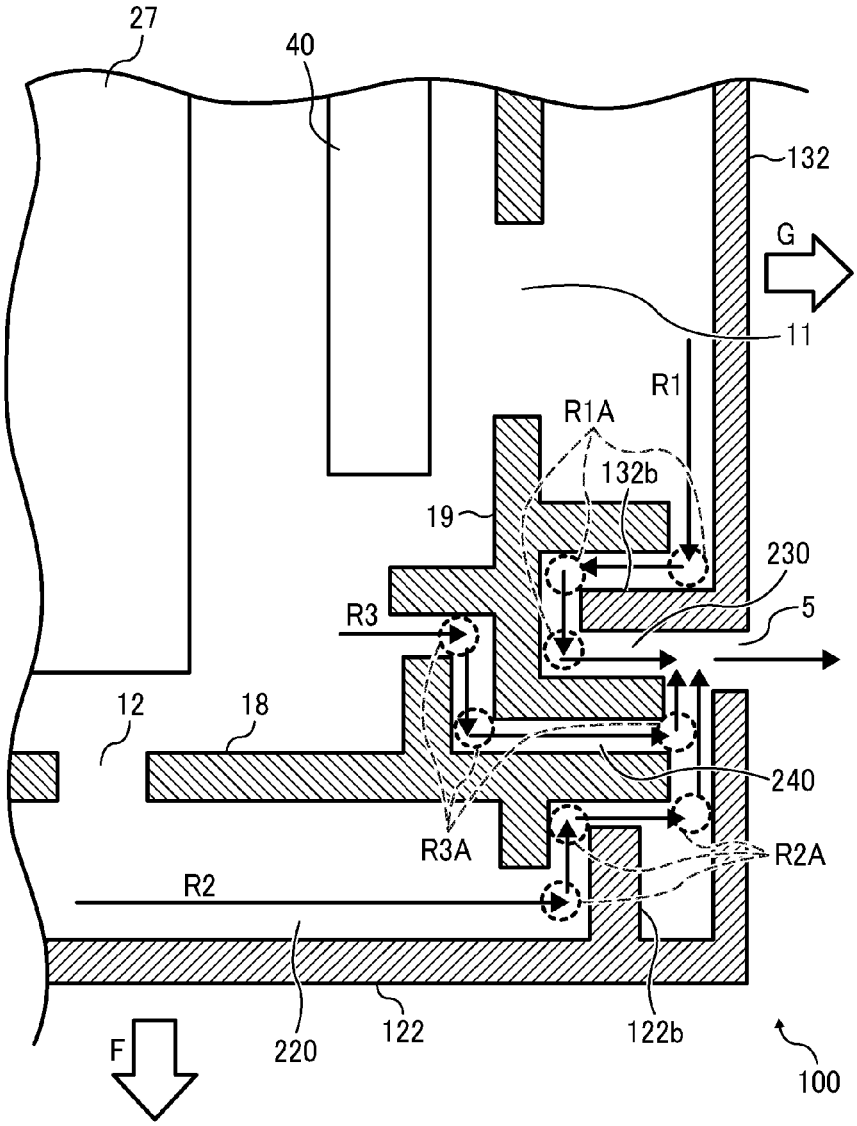
FIG. 5 is an enlarged horizontal cross-sectional view of a boundary between a front opening-and-closing cover and a right-side opening-and-closing cover of a second embodiment.

Next, a second embodiment (hereinafter, referred to as a "second embodiment") of a housing structure to which the present disclosure is applied will be described. FIG. 5 is an enlarged horizontal cross-sectional view in which a boundary between a front opening-and-closing cover 122 and a right-side opening-and-closing cover 132 of a printer 100 of a second embodiment is viewed from the top.

The printer 100 of the second embodiment is provided with two inner members of a front interior cover 18 facing the front opening-and-closing cover 122, and a right-side interior cover 19 facing the right-side opening-and-closing cover 132, instead of the interior cover 1 of the first embodiment. The front interior cover 18 and the right-side interior cover 19 are fixed to the body frame. A first interior opening 11 is provided on the right-side interior cover 19, and the second interior opening 12 is provided on the front interior cover 18.

Similarly to the first embodiment, the printer 100 of the second embodiment forms an outer cover opening 5 serving as an exit of the flow of sound and air from inside of the apparatus at a boundary between the front opening-and-closing cover 122 and the right-side opening-and-closing cover 132. There is a gap 230 between the right-side interior cover 19 and the right-side opening-and-closing cover 132, and a first path R1 through which internal heat and sound of the apparatus are directed to the outer cover opening 5 is formed by the gap 230. Further, there is also a gap 220 between the front interior cover 18 and the front opening-and-closing cover 122, and a second path R2 through which the internal heat and sound of the apparatus are directed toward the outer cover opening 5 is formed by the gap 220. In addition, in the printer 100 of the second embodiment, there is a gap 240 between the front interior cover 18 and the right-side interior cover 19, and a third path R3 through which the internal heat and sound of the apparatus are directed to the outer cover opening 5 is formed by the gap 240. The first path R1, the second path R2 and the third path R3 have three or more bent portions R1A and R2A by which the sound and heat paths change at a right angle.

In the printer 100 of the second embodiment, the air can pass through the first path R1, the second path R2 and the third path R3. Therefore, heat generated inside the printer 100 can be emitted to the outside via the first path R1, the second path R2 and the third path R3, and it is possible to suppress a temperature rise inside the printer 100. In addition, the first path R1, the second path R2 and the third path R3 have a labyrinth shape having a plurality of bent portions R1A and R2A. Therefore, sound generated inside the printer 100 and directed to the outside through the first path R1, the second path R2 or the third path R3 cannot exit to the outside of the printer 100, if the sound is not diffracted for a plurality of times. Since sound is attenuated each time it is diffracted, by diffracting the sound directed toward the outside from the inside for a plurality of times, it is possible to suppress the sound leakage.

As described above, in the complicated labyrinth shape having the bent portions R1A and R2A of the plurality of positions, the airflow is hard to pass, and the flow rate decreases. In the printer 100 of the second embodiment, the third path R3 is included in addition to the first path R1 and the second path R2, the paths of gas more than those of the first embodiment are included. Thus, it is possible to ensure the more flow rate of air flowing from the inside to the outside of the apparatus, and it is possible to maintain the exhaust heat efficiency even in a configuration in which the labyrinth shape is provided in the path of gas.

Furthermore, a single outer cover opening 5 is provided through which three paths of gas of the first path R1, the second path R2 and the third path R3 communicate with the outside of the apparatus. As a result, it is possible to reduce the housing opening through which the sound generated inside the apparatus leaks to the outside, and thus, it is possible to suppress the sound leakage as compared to a configuration in which each of the three paths of gas communicates with the outside via individual housing openings. Thus, in the printer 100 of the second embodiment, by ensuring the airflow directed from the inside to the outside of the apparatus, it is possible to suppress the sound leakage, while preventing the temperature rise inside the apparatus.

The width of the cross-section illustrated in FIG. 5 of the outer cover opening 5 of the first embodiment and the second embodiment is set to be wider than the width of the path of gas (the first path R1, the second path R2 and the third path R3). Thus, the opening area of the outer cover opening 5 is larger than the cross-sectional areas of the first path R1 and the second path R2. Thus, even in a configuration in which the paths of gas are joined, it is possible to suppress the airflow from being stagnated near the outer cover opening 5 serving as an exit, thereby maintaining the exhaust heat efficiency. In the printer 100 of the first embodiment and the second embodiment, the width of the path of gas is 3.0 [mm], and the width of the outer cover opening 5 is 4.0 [mm], but the dimensions are not limited thereto. Also, the widths of each path of gas and the width of the outer cover opening 5 may be set to be the same, and the width of the outer cover opening 5 may be set to be narrow.

Figure 6:
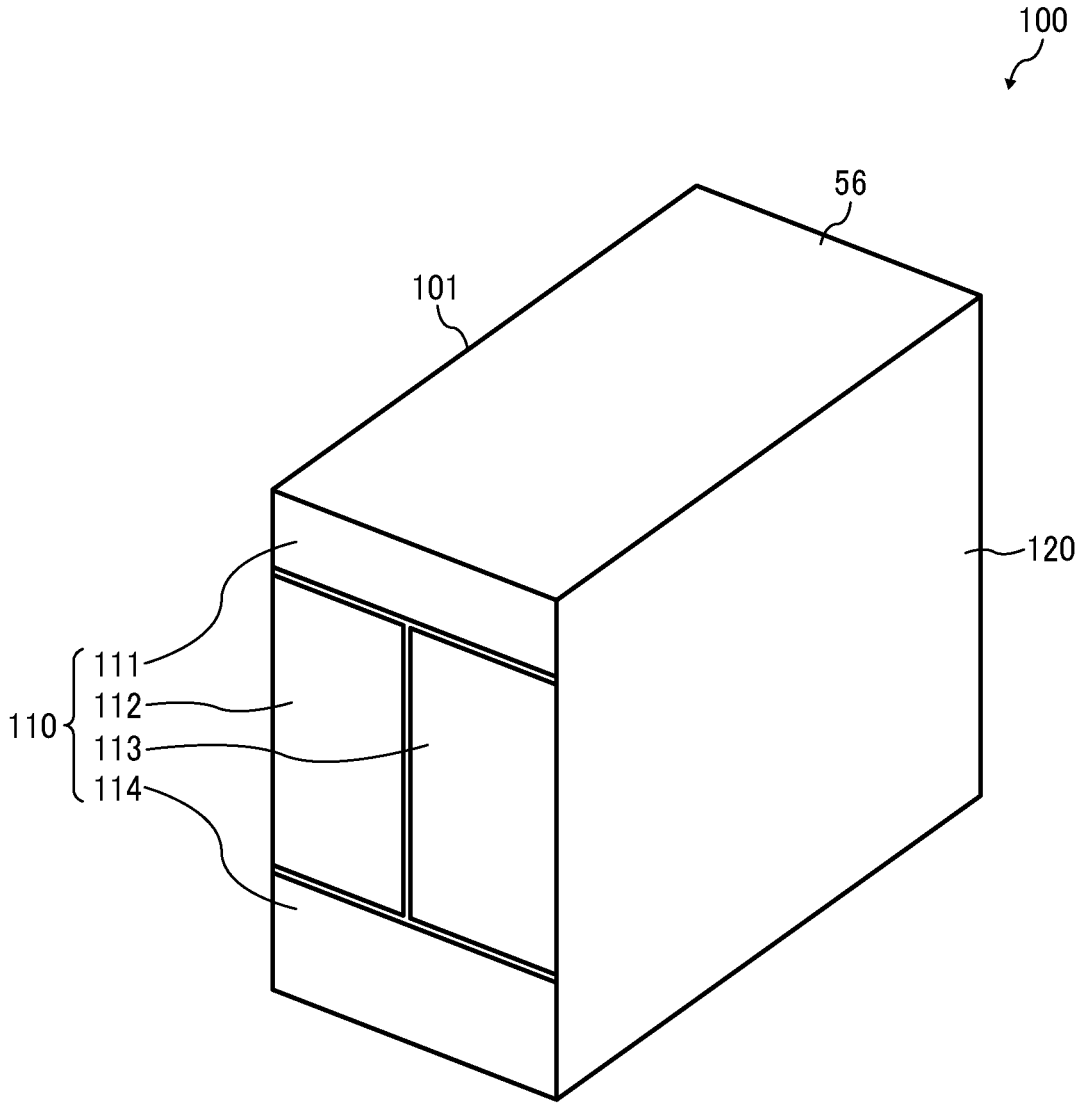
FIG. 6 is an explanatory perspective view of a printer in which the left-side cover is formed by a plurality of outer covers.

FIG. 6 is an explanatory perspective view of the printer 100 that schematically illustrates an embodiment of a configuration in which the left side cover 110 covering the left side surface is formed by a plurality of outer covers in FIG. 2 of the printer 100. As illustrated in FIG. 6, the left side cover 110 is formed by four outer covers of a first left side cover 111, a second left side cover 112, a third left side cover 113 and a fourth left side cover 114. These four outer covers are fixed to the body frame as the stationary cover members.

A gap formed between the stationary cover member and the inner member is set to a size that allows the variations in component tolerance of the stationary cover member and the inner member. That is, even under the condition in which the component tolerance narrows the gap forming the path of gas to the highest degree, the gap is set to a value in which the path of gas is not closed by the stationary cover member and the inner member. Thus, it is possible to release the heat from the path of gas of the gap formed between the stationary cover member and the inner member, and it is possible to suppress a temperature rise inside the printer 100.

In the first and second embodiments described above, the configuration in which a plurality of paths of gas having a labyrinth shape is formed in the gap between the opening-and-closing cover and the inner member. The cover member forming a path of gas having a labyrinth shape in the gap between the cover member and the inner member is not limited to the opening-and-closing cover, and may be a stationary cover member fixed to the body frame. When the cover member that forms the path of gas is the stationary cover member, it is possible to enhance a positional accuracy with the inner member than the opening-and-closing cover, and an error in the width of the path of gas can be reduced.

In the first and second embodiments described above, the description has been given of a case where the path of gas with the labyrinth shape is a heat exhaust path that ejects the heat generated inside the apparatus to the outside. The path of gas may be an air suction path that guides an external low-temperature air into the apparatus, without being limited to the heat exhaust path. Even in the case of the air suction path, by providing a plurality of paths of gas, it is possible to secure the flow rate of air directed toward the inside from the outside of the housing, it is possible to maintain the cooling efficiency even in a configuration in which a complicated shape is provided in the path of gas, and it is possible to suppress the sound leakage, while suppressing the temperature rise inside the housing.

In the present embodiment, although the description has given of the case where the housing structure equipped with the cover member is the housing of the image forming apparatus, the present disclosure is also applicable to an electronic apparatus other than the image forming apparatus, as long as a configuration includes a sound source device that generates sound during operation, and a sound absorber that absorbs sound generated from the sound source device. Furthermore, a configuration that forms a gap as a characteristic part of the present disclosure is applicable, as long as a housing structure requires suppression of sound leakage from the inside to the outside, without being limited to the electronic apparatus.

The above description is an example, and the present disclosure exhibits peculiar effects for each following aspect.

(Aspect A) In a housing structure such as the outer cover and the interior cover 1 of the printer 100 equipped with the cover members, such as the front opening-and-closing cover 122 and the right-side opening-and-closing cover 132 which partially partition the inside and the outside of the housing, a plurality of paths of gas such as the first path R1 and the second path R2 that connect the inside and the outside of the housing and have a bypass portion such as a plurality of bent portions R1A and R2A is formed, two or more paths of gas among the plurality of paths of gas communicate with the outside of the cover member via a housing opening such as a single outer cover opening 5 which communicates with the inside and the outside of the cover member. Accordingly, as described in the above embodiment, since gas such as air can move via the path of gas that connects the inside and outside of the housing, it is possible to prevent heat from being confined inside the housing and to suppress a temperature rise inside the housing. Moreover, since the path of gas has a complicated shape such as having a plurality of bypass portions, the sound generated in the housing and trying to move toward the outside through the path of gas cannot exit to the outside of the housing, if the sound is not diffracted for a plurality of times. Since the sound decreases when diffracted for a plurality of times, it is possible to suppress the sound leakage from the path of gas even in a configuration in which the path of gas connecting the inside and outside of the housing is provided. In a complicated shape having a plurality of bypass portions, the flow of gas is hard to pass and the flow rate of gas decreases. However, by providing a plurality of paths of gas, it is possible to ensure the flow of gas directed toward the outside from the inside of the housing. Thus, even in a configuration in which a complicated shape is provided in the path of gas, the exhaust heat efficiency can be maintained. Moreover, by providing a single housing opening through which two or more paths of gas among the plurality of paths of gas communicate with the outside of the housing, it is possible to reduce the housing opening through which the sound generated inside the housing can leak to the outside, and it is possible to suppress the sound leakage as compared to the configuration in which each of the plurality of paths of gas communicates with the outside via the individual housing openings. Thus, in the aspect A, in the housing structure equipped with the cover member, it is possible to suppress the sound leakage, while suppressing the temperature rise inside the housing.

Figure 7:
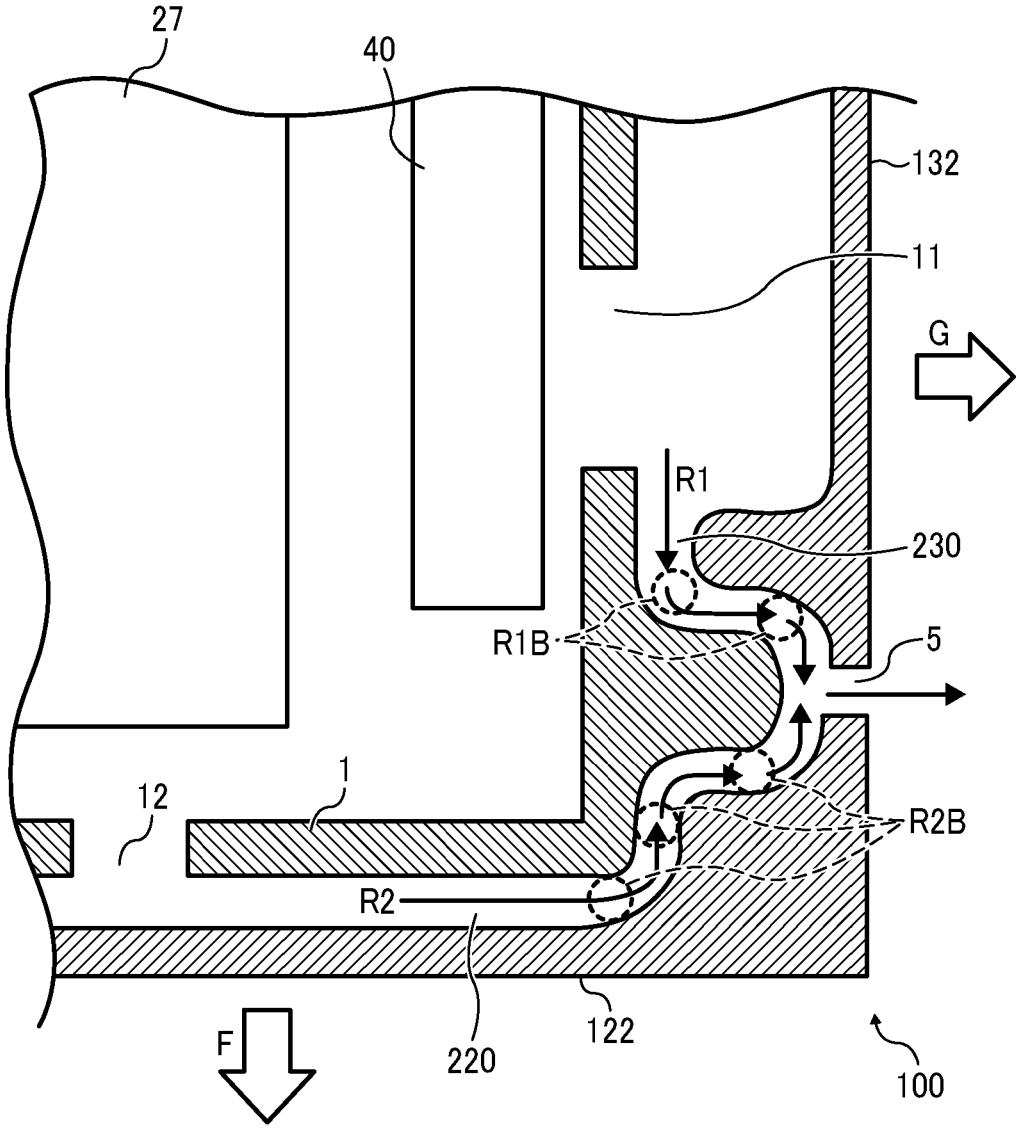
FIG. 7 is an enlarged horizontal cross-sectional view of the boundary between the front opening-and-closing cover and the right-side opening-and-closing cover of the configuration in which bypass portions of a first path and a second path are curved portions.

Further, the bypass portions are bent portions, such as R1A and R2A, or curved portions, such as R1B and R2B, provided on the paths of gas that can be linearly connected, and are portions that reroute the paths of gas rather than linearly connecting the paths of gas through which the sound is transmitted. FIG. 7 is an enlarged horizontal cross-sectional view in which the boundary between the front opening-and-closing cover 122 and the right-side opening-and-closing cover 132 of the printer 100 in which the bypass portions of the first path R1 and the second path R2 are the curved portions R1B and R2B is viewed from the top. As illustrated in FIG. 7, even in a configuration in which the first path R1 and the second path R2 form a labyrinth shape by a plurality of bent portions R1A and R2A, it is possible to suppress the sound leakage, while suppressing the temperature rise inside the housing.

(Aspect B) In aspect A, at least one of the two or more paths of gas, such as the first path R1 and the second path R2, is formed in a gap, such as 220 or 230, between the inner member such as the interior cover 1 located inside the cover member such as the front opening-and-closing cover 122 and the right-side opening-and-closing cover 132, and the cover member. Accordingly, as described in the above embodiment, in order to form the path of gas which has a plurality of bypass portions, there is no need to provide a new member such as a labyrinth shape, and it is possible to suppress the cost of providing the path of gas.

(Aspect C) In aspect B, the cover member that forms the gap, such as 220 or 230, is a stationary cover member, such as the first left side cover 111, the second left side cover 112, the third left side cover 113 and the fourth left side cover 114 that are fixed to the housing structure body such as the body frame. Accordingly, as described in the above embodiments, it is possible to enhance a positional accuracy with the inner member than the opening-and-closing cover, and it is possible to reduce errors in the width of the path of gas.

(Aspect D) In any one aspect of aspect B or aspect C, at least one of the cover members that forms a gap, such as 220 or 230, is an opening-and-closing cover such as the front opening-and-closing cover 122 and the right-side opening-and-closing cover 132 that can be opened and closed. Accordingly, as described in the above embodiments, it is possible to form the first path R1 and the second path R2 in the gap between the opening-and-closing cover and the inner member exposed by opening the opening-and-closing cover, and it is not necessary to provide a new member to form the paths of gas. Thus, it is possible to suppress the cost of providing the paths of gas.

(Aspect E) In any one aspect of aspects B through D, a plurality of cover members such as the front opening-and-closing cover 122 and the right-side opening-and-closing cover 132 that form a gap, such as 220 or 230, forming the first path R1 and the second path R2 is provided between the cover member and the inner member such as the interior cover 1, two of the cover members forming the gap are disposed adjacent to each other and each of the cover members are openable opening-and-closing covers, and both of the two opening-and-closing covers can be opened and closed from either side. Accordingly, as described in the above embodiment, it is possible to ensure a gap of the boundary between the opening-and-closing covers, without deteriorating the effect of suppressing the sound leakage. Moreover, since both of the two opening-and-closing covers can be opened and closed from either side, even in a configuration in which the paths of gas of a complicated shape are formed, it is possible to prevent an adverse effect on the usability.

(Aspect F) In any one aspect of the aspect D or E, with respect to the position of the opening-and-closing cover in a state in which the closing of the opening-and-closing cover such as the front opening-and-closing cover 122 and the right-side opening-and-closing cover 132 is completed, a gap, such as 220 or 230, that forms the first path R1 and the second path R2 is greater than a pushing amount as an amount of movement up to a position that can be moved by pushing at the time of closing. Accordingly, as described in the above embodiments, even when the opening-and-closing cover enters the inside as compared to a state in which the closing is completed by the closing operation, it is possible to prevent the opening-and-closing cover from coming into contact with the inner member such as the interior cover 1 in a portion that forms the gap. Thus, it is possible to avoid a risk of damage caused by contact between the cover member forming the gap serving as the path of gas and the inner member during the opening and closing operations, while maintaining the effects of sound leakage prevention by having a complicated shape.

(Aspect G) In any one aspect of the aspects D through F, the gap that forms the path of gas such as the first path R1 and the second path R2 has a size that allows variations in the component tolerances and the clearance of a movable part. Accordingly, as described in the above embodiments, even under the condition in which the component tolerance and the clearance of the movable part narrow the gap to the highest degree, it is possible to release the heat from the path of gas formed by the gap, and it is possible to suppress the sound leakage, while suppressing the temperature rise inside the housing.

(Aspect H) In any one aspect of the aspects A through G, an inner cover member such as the interior cover 1 is included which is located inside the cover member such as the front opening-and-closing cover 122 and the right-side opening-and-closing cover 132, and spatially partitions the inside and the outside of the cover member. Accordingly, as described in the above embodiments, even when opening the opening-and-closing cover, it is possible to achieve a configuration in which the respective apparatuses used for the image formation are not exposed.

(Aspect I) In the housing structure described in the aspect H, a plurality of inner cover openings such as the first interior opening 11 and the second interior opening 12 is included, through which the inside and the outside of the inner cover member such as the interior cover 1 communicate with each other, and the plurality of inner cover openings communicates with the outside of the cover member such as the front opening-and-closing cover 122 and the right-side opening-and-closing cover 132 via the plurality of respective paths of gas such as the first path R1 and the second path R2 different from each other. Accordingly, as described in the above embodiments, it is possible to prevent the heat from being confined to the inside of the interior cover 1, and it is possible to suppress the temperature rise inside the interior cover 1.

(Aspect J) In any one aspect of the aspects H or I, a plurality of inner cover members such as the front interior cover 18 and the right-side interior cover 19 is provided, a gap, such as 240, through which the inside and the outside of the inner cover member communicate with each other is formed between the adjacent inner cover members, and at least one of the two or more paths of gas such as the third path R3 is formed in the gap between the inner cover members. Accordingly, as described in the second embodiment, it is possible to secure the more flow rate of gas such as air directed from the inside to the outside of the apparatus, and even in a configuration in which a shape having a plurality of bypass portions of the labyrinth shape or the like is provided in the path of gas, it is possible to maintain the exhaust heat efficiency.

(Aspect K) In any one aspect of the aspect B, C or J, a gap that forms the paths of gas such as the first path R1 and the second path R2 has a size that allows variations in component tolerances. Accordingly, as described in the above embodiments, even under the condition in which the component tolerances narrow the gap to the highest degree, it is possible to release the heat from the gap, and it is possible to suppress the temperature rise inside the housing.

(Aspect L) In any one of the aspects A through K, there are three or more bypass portions such as bent portions R1A and R2A. Accordingly, as described in the above embodiments, it is possible to increase the number of diffraction times of the sound that tries to go to the outside through the gap as compared to a case where there are only two bypass portions, and the sound leakage can be further prevented. Further, since there are three or more bent portions R1A and R2A, even when a part of the portion forming the gap that forms the path of gas, such as the first path R1 and the second path R2, is deformed, the diffracting structure can be maintained, and it is possible to maintain the effect of suppressing the sound leakage.

(Aspect M) In any one aspect of the aspects A through L, the bypass portions such as the bent portions R1A and R2A are provided near the housing opening. Accordingly, as described in the above embodiments, it is possible to suppress a temperature rise inside the housing in the path of gas, such as the first path R1 and the second path R2.

(Aspect N) In any one aspect of the aspects A through M, a plurality of cover members such as the front opening-and-closing cover 122 and the right-side opening-and-closing cover 132 is included, and the housing opening such as the outer cover opening 5 is a gap formed between the adjacent cover members. Accordingly, as described in the above embodiments, the boundary between the cover members is set as the outer cover opening 5, and the path of gas, such as the first path R1 and the second path R2, through which the sound is transmitted from the inside of the apparatus to the housing opening, has a plurality of bypass portions. With such a configuration, while suppressing the sound inside the apparatus from leaking to the outside, it is possible to release the heat inside the housing from the housing opening through the path of gas and to suppress the temperature rise. Also, since it is not necessary to seal the portion that is the boundary between the cover members, it is possible to suppress an increase in manufacturing cost.

(Aspect O) In any one of the aspects A through N, the opening area of the housing opening such as the outer cover opening 5 is larger than the cross-sectional area of the path of gas, such as the first path R1 and the second path R2. Accordingly, as described in the above embodiments, even in a configuration in which the paths of gas are joined, it is possible to suppress the flow of gas such as air from being stagnated near the housing opening and to maintain the exhaust heat efficiency.

(Aspect P) In an electronic apparatus such as the printer 100 that includes a sound source device such as the optical writing unit 27 or a drive device that generates sound during operation, and the housing such as the outer cover that covers the sound source device, the housing structure according to any one of the aspects A through O is used as an a housing. Accordingly, as described in the above embodiments, it is possible to prevent the sound generated during operation of the electronic apparatus from leaking to the outside, while suppressing the temperature rise inside the apparatus during operation of the electronic apparatus.

(Aspect Q) In an electrophotographic image forming apparatus such as the printer 100, a configuration of an electronic apparatus according to the aspect P is included. Accordingly, as described in the above embodiments, it is possible to prevent the sound generated at the time of image formation from leaking to the outside, while suppressing the temperature rise inside the apparatus during image formation.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A housing structure, comprising:

a housing;

an interior cover disposed inside the housing;

a first cover including a first projection; and a second cover including a second projection, the first cover and the second cover spatially partitioning an internal side and an external side of the housing, an external opening existing between the first cover and the second cover, the first cover and the interior cover forming a first multi-angled passage there-between, including a plurality of angled passageways leading to the external opening, the second cover and the interior cover forming a second multi-angled passage there-between, including a plurality of angled passageways leading to the external opening, and the external opening, the first multi-angled passage, and the second multi-angled passage being spatially continuous with each other and at least one of the first cover and the second cover being an opening-and-closing cover, wherein at least one of the first and second multi-angled passage includes a gap, between the at least one of the first cover and the second cover that is an opening-and-closing cover and the interior cover, that is relatively greater than an amount at which the opening-and-closing cover is movable toward the interior cover from a closed position of the opening-and-closing cover at which closing of the opening-and-closing cover is completed.

2. The housing structure of claim 1, wherein the first multi-angled passage includes three or more angled passageways, and wherein the second multi-angled passage includes three or more angled passageways.

3. An electronic apparatus, comprising:

a sound source device to generate sound during operation;

a housing covering the sound source device; and the housing structure of claim 2, the first and second multi-angled passages being configured to attenuate the generated sound.

4. An electrophotographic image forming apparatus comprising the electronic apparatus of claim 3.

5. The housing structure of claim 2, wherein each of the three or more angled passageways of the first multi-angled passage are substantially 90°, and wherein each of the three or more angled passageways of the second multi-angled passage are substantially 90°.

6. The housing structure of claim 1, wherein the first cover and the second cover are disposed adjacent to each other, with the external opening existing there-between, and wherein the first cover and the second cover are opening-and-closing covers openable and are closable from any of the first cover and the second cover.

7. The housing structure of claim 1, wherein the gap between the at least one of the first cover and the second cover that is an opening-and-closing cover and the interior cover has a size that allows variations in component tolerances and clearance of a movable part.

8. The housing structure of claim 1, wherein the interior cover includes a first and second interior cover.

9. The housing structure of claim 8, wherein the first interior cover and the second interior cover form a third multi-angled passage there-between, including a plurality of angled passageways eventually leading to the external opening.

10. The housing structure of claim 9, wherein the first multi-angled passage includes three or more angled passageways, and wherein the second multi-angled passage includes three or more angled passageways.

11. The housing structure of claim 10, wherein each- of the three or more angled passageways of the first multi-angled passage are substantially 90° , and wherein each of the three or more angled passageways of the second multi-angled passage are substantially 90° .

12. The housing structure of claim 9, wherein the first multi-angled passage includes three or more angled passageways, wherein the second multi-angled passage includes three or more angled passageways, and wherein the third multi-angled passage includes three or more angled passageways.

13. An electronic apparatus, comprising:

a sound source device to generate sound during operation;

a housing covering the sound source device; and the housing structure of claim 12, the first and second multi-angled passages being configured to attenuate the generated sound.

14. An electrophotographic image forming apparatus comprising the electronic apparatus of claim 13.

15. An electronic apparatus, comprising:

a sound source device to generate sound during operation;

a housing covering the sound source device; and the housing structure of claim 9, the first and second multi-angled passages being configured to attenuate the generated sound.

16. An electrophotographic image forming apparatus comprising the electronic apparatus of claim 15.

17. An electronic apparatus, comprising:

a sound source device to generate sound during operation;

a housing covering the sound source device; and the housing structure of claim 1, the first and second multi-angled passages being configured to attenuate the generated sound.

18. An electrophotographic image forming apparatus comprising the electronic apparatus of claim 17.

* * * * *